United States Patent [19]

Norton et al.

[11] Patent Number: 4,534,491

[45] Date of Patent: Aug. 13, 1985

[54] WET TISSUE DISPENSING PORT

[75] Inventors: Henry J. Norton, Wilmington, Del.; Kenard E. Urion, Woodbury, N.J.

[73] Assignee: Scott Paper Company, Philadelphia, Pa.

[21] Appl. No.: 395,568

[22] Filed: Jul. 6, 1982

[51] Int. Cl.[3] ..... A47K 10/38

[52] U.S. Cl. ..... 221/63; 221/310

[58] Field of Search ..... 221/63, 310; 206/205, 206/210, 409

[56] References Cited

U.S. PATENT DOCUMENTS

| | | | |
|---|---|---|---|
| 2,004,614 | 6/1935 | Meagher . | |
| 2,317,102 | 4/1943 | McKaig . | |
| 2,806,591 | 9/1957 | Appleton . | |
| 3,749,296 | 7/1973 | Harrison | 225/106 |
| 3,862,472 | 1/1975 | Norton et al. | 19/145.5 |
| 3,868,052 | 2/1975 | Rockefeller | 225/106 |
| 3,879,257 | 4/1975 | Gentile et al. | 162/112 |
| 3,973,695 | 8/1976 | Ames | 221/63 |
| 3,982,659 | 9/1976 | Ross | 221/63 |
| 4,017,002 | 4/1977 | Doyle | 221/63 |
| 4,219,129 | 8/1980 | Sedgwick | 221/63 |
| 4,328,907 | 5/1982 | Beard | 221/63 |

FOREIGN PATENT DOCUMENTS

| | | | |
|---|---|---|---|
| 2542038 | 4/1976 | Fed. Rep. of Germany | 221/63 |
| 2802443 | 7/1979 | Fed. Rep. of Germany | 221/310 |
| 7721 | of 1899 | United Kingdom . | |
| 1419167 | 12/1975 | United Kingdom | 221/63 |
| 1472366 | 5/1977 | United Kingdom . | |

*Primary Examiner*—F. J. Bartuska

*Attorney, Agent, or Firm*—Joseph H. Yamaoka; John W. Kane, Jr.

[57] ABSTRACT

A dispensing port in a wall of a container 10 for dispensing perforated sheets. The dispensing port comprises three slots 62 generally extending radially from a central opening 61 of the dispensing port to form three flexible, triangular flaps 56, the apex 58 of each flap 56 being rounded. The flaps 56 apply tension to a leading sheet being pulled through the slots 62 to cause the leading sheet to be separated from the next sheet at the perforations while leaving a tip 75 of the next sheet projecting through the dispensing port.

5 Claims, 5 Drawing Figures

WET TISSUE DISPENSING PORT

TECHNICAL FIELD

This invention relates generally to pop-up dispensers for a wet web that has been transversely perforated to form successively interconnected wipers. More particularly, this invention relates to an improved dispensing port capable of reliably dispensing premoistened, tab interconnected webs which have a higher ratio of wet thickness to dry basis weight than prior premoistened webs.

BACKGROUND ART

Dispensers that provide for the individual pop-up dispensing of successive wet sheets are known in the prior art. It is believed that the prior art dispensers have been primarily designed to dispense moistened nonwoven webs manufactured by the carding process. As is well known in the art, carded nonwoven webs are made with textile length fibers that are very highly oriented in a machine direction of the web, which, in the finished moistened web product, is perpendicular to the line of perforations which define the interconnecting tabs between individual sheets. Because of the long fibers and their orientation, the dispensing ports for such carded nonwoven webs consist of holes or a slit which exert considerable force on the web as it is being dispensed.

One example of a moistened carded nonwoven web product available in the market place is a lotion impregnated wiper for babies. The carded web, before it is impregnated has a dry basis weight of about 25.4 grams per square meter (15.0 pounds per ream of 2880 square feet) and a thickness after it has been moistened of about 0.22 millimeters (0.0085 inches). The ratio of the thickness (meters) of a wet sheet to the dry basis weight (kilograms per square meter) of the sheet, called the wet bulk ratio, provides a good measure of the bulk of the product. For the previously described baby wiper, the bulk ratio is about 0.00855 meters per kilogram per square meter (0.00057 inches per pound per ream of 2880 square feet).

Carded nonwoven webs and wet wipers made therefrom are generally not perceived by consumers to be bulky. Applicants have found it desirable to make a moistened wiper using relatively bulkier nonwoven webs such as those manufactured by an air-laying process as described in U.S. Pat. No. 3,862,472—Norton et al or by a wet-forming process as described in U.S. Pat. No. 3,879,257—Gentile et al, both patents being assigned to the assignee of this invention. The bulkier nonwoven webs made in accordance with the Norton et al and Gentile et al patents tend to be weaker in the direction perpendicular to the perforations between sheets than comparable carded nonwoven webs because these bulkier webs consist predominately or entirely of short fibers, such as wood pulp fibers and cotton linters, and because the fibers are not as highly oriented in the machine direction when the web is initially formed. Because of this increased bulk and decreased strength in the direction perpendicular to the line of perforations, it has been found that many of the prior art pop-up dispensers are not suitable for dispensing such premoistened webs.

British Pat. No. 7721/1899—Utermohlen discloses a dispenser which utilizes a slot having contacting edges to hermetically seal the contents of the dispenser.

U.S. Pat. No. 2,004,614—Meagher discloses a container having a dispensing opening formed by a plurality of slits which result in flaps that act upon the material being dispensed in such a manner as to sever the material above the dispensing opening rather than in the opening itself.

U.S. Pat. No. 2,806,591—Appleton similarly discloses the use of a dispensing opening for automatically severing the material passing through the opening.

U.S. Pat. No. 4,017,002—Doyle et al, like Utermohlen, disclose forming a dispensing opening with contacting edges for sealing purposes. Doyle et al, like Meagher and Appleton, also disclose using edges of the opening for causing the material to sever. Doyle et al indicate that the container is used as a pop-up dispenser for moist tissues, although Doyle et al do not disclose the critical guidelines with respect to, for example, the type of material being dispensed and how it is perforated. Applicants have found that the dispenser described by Doyle et al cannot satisfactorily dispense bulky, premoistened air-layed and wet formed webs. Because the edges of the slit are so close together, they exert a considerable frictional force on the weaker, bulkier tissue with the result that many sheets tear at places other than the perforations or in some instances where the sheet parts at the perforations, the succeeding sheet does not pop-up through the dispensing slit. Another problem with the Doyle et al dispenser is that as a bulky sheet is dispensed through the slit, it "ropes" excessively, that is it twists and gathers, and the large forces exerted on the sheet by the edges of the slit cause the moisture in the sheet to be extruded off the sheet, particularly where the edges of the slit contact the sheet. This results in the withdrawn sheet having a streaked, uneven distribution of moisture. The Doyle et al patent also discloses a cross-shaped dispensing port formed by two intersecting slits. This dispensing port has the same problems as the single slit dispensing port and additionally, because of the pointed sectors at the center of the dispensing port, has even a greater tendency to tear or shred the bulkier air-layed and wet-formed webs other than at the perforations.

U.S. Pat. No. 3,868,052—Rockefeller discloses a dispensing port for a moist towelette that comprises an aperture and a plurality of sharp projections that extend into the opening of the aperture. As a sheet is dispensed, one or more of the projections catch onto the perforations to start the tearing action. Applicants have found that when dispensing moist, bulky webs, it is undesirable to have sharp projections within the dispensing aperture because the sharp projections tend to catch and tear the web at places other than at the perforations.

U.S. Pat. No. 3,749,296—Harrison discloses a dispensing port in which either a single slit is formed in an inclined plane or two intersecting slits are formed in the surface of an inverted cone. In both embodiments the edges of the slits are in substantially contacting relationship and therefore suffer the disadvantages enumerated in the above discussion of the Doyle et al patent.

U.S. Pat. No. 4,219,129—Sedgwick discloses a dispenser for moist tissues or towelettes in which the dispensing port is a frustoconical orifice. The orifice acts to impose a drag on the roped tissue that is insufficient to cause severance of the end tissue at its line of perforation until this line is advanced by the user beyond the orifice and the exposed tissue is subjected to a snap action, causing severance of the end tissue from the web. The tail of the succeeding tissue now protrudes above the orifice to permit its subsequent extraction.

U.S. Pat. No. 3,973,695 discloses another prior art dispenser for moist tissues in which the dispensing port is an aperture having an enlarged triangular portion at one end and a generally circular portion at the other end. The enlarged triangular portion of the dispensing port facilitates the threading of the lead end of a tissue through the dispensing port. Once the lead end of a tissue is threaded through the dispensing port, the lead end of the tissue is pulled into and through the circular portion of the dispensing port until the lead tissue is completely outside the container. The leading tissue is then pulled radially outward from the container to cause the lead tissue to separate at the perforations.

U.S. Pat. No. 3,982,659—Ross assigned to the assignee of this invention discloses a dispensing port having flexible flaps for dispensing premoistened wipers.

U.S. Pat. No. 2,317,102—McKaig discloses a dispenser for cotton in which a sulphite paper disk has a centrally located circular aperture with cuts or slits extending radially out from the aperture.

DISCLOSURE OF THE INVENTION

In accordance with the invention, there is provided a dispensing port for a bulky web that has been transversely perforated to form successively interconnected sheets. In a preferred embodiment, the dispensing port comprises three slots generally extending radially from a central opening of the dispensing port to form three flexible, obtuse triangular flaps, the obtuse angle of each flap preferably being rounded and free of sharp edges. The flaps apply tension to a leading wiper being pulled through the slots to cause the leading wiper to be separated from the next wiper at the perforations while leaving a tip of the next wiper projecting through the dispensing port. In another aspect of the invention, the lower edges of the flaps adjacent the interior of the container are also rounded.

The dispensing port is particularly useful for dispensing premoistened wipers having a wet bulk ratio exceeding 0.009 meter per kilogram per square meter (0.0006 inches per pound per ream of 2880 square feet).

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

For the sake of convenience, certain elements described with reference to a specific figure will retain the same reference designation in the description of subsequent figures.

Figure 2:
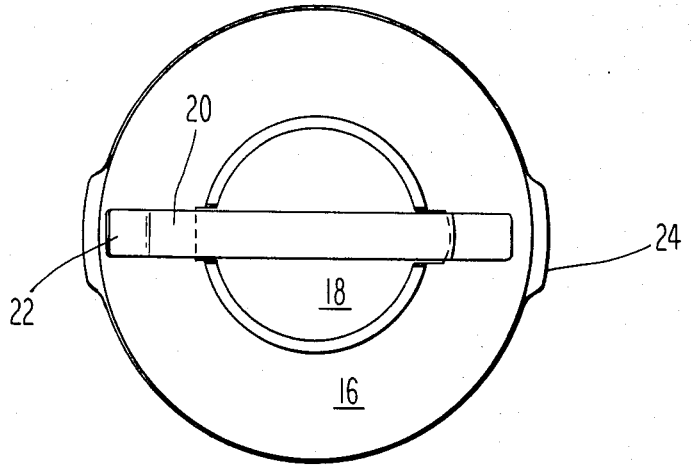
FIG. 2 is a plan view of the dispenser.
Figure 1:
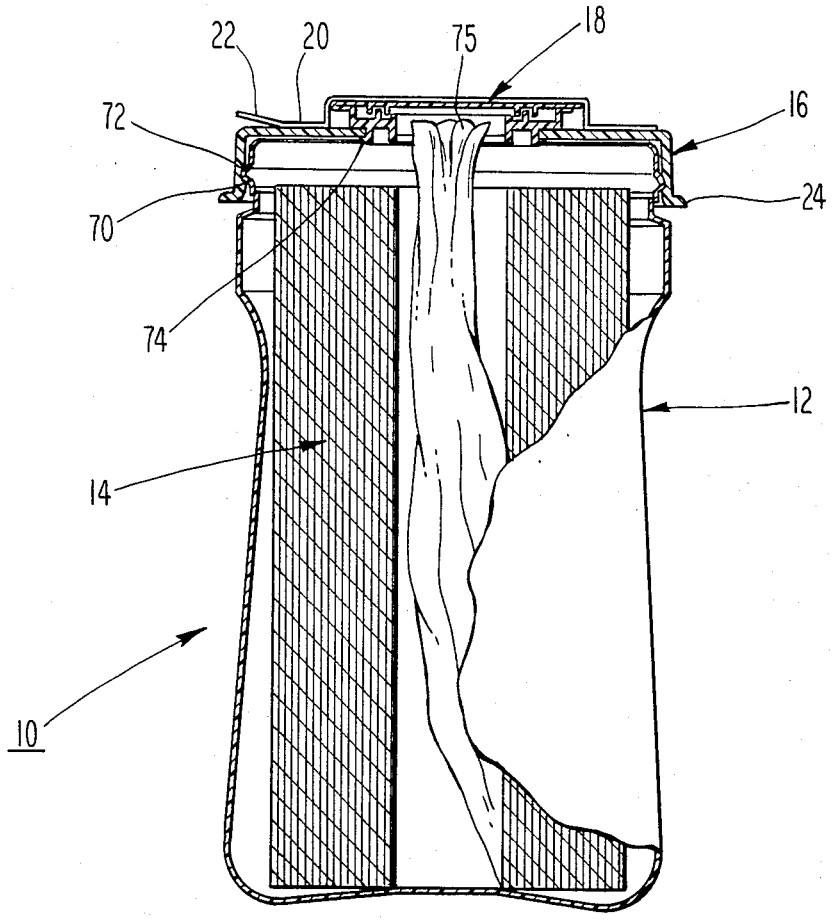
FIG. 1 is a partially sectional, front elevational view of the dispenser.

Referring now to FIG. 1, a container 10 for the pop-up dispensing of a roll 14 of premoistened sheets includes a bottle 12 and a cover assembly 16. The dispensing port which is the subject of this invention, is part of a port subassembly 18 that snaps into the cover 16 but could be molded integrally as part of the top of container 10. Surrounding the open mouth of the bottle 12 is an annular bead 72. The inner wall of the cover 16 also has an annular bead 70. To close the container 10, the cover 16 is pressed over the mouth of the bottle 12 so that the bead 70 on the inner wall of the cover 16 is forced over the bead 72 surrounding the mouth of the bottle 12. As shown in FIG. 1, the cooperation of bead 70 and bead 72 provides a seal which retards the loss of moisture from the container 10. Each side of the cover 16 has a projecting tab 24 which can be grasped by the consumer to pry the cover 16 off of the bottle 12. The cap portion 32 of the port subassembly 18 is sealed by means of a tape 20 which overlies and is adhered to the top of the cover 16 and the cap portion 32 of the port subassembly 18. One end portion 22 of the tape 20, which has been left unadhered to the top of the cover 16, can be readily grasped by the consumer when it is desired to remove the tape 20 from the container 10.

The roll 14 of web material has been premoistened so that it is "wet". By "wet" is meant that the web material contains an aqueous or other desired treatment medium such that when the wetted material is wiped across a surface, the surface is streaked by the liquid medium. In a preferred embodiment of this invention, the treatment medium is aqueous, and provides a moisture content of between about 100% and about 350% by weight based on the dry weight of the sheet. In one commercial embodiment of this invention, the sheets are premoistened wipers for babies having a moisture content in excess of 250% based on the dry weight of the sheet.

The dispensing port of this invention is specifically adapted for the dispensing of premoistened web materials wherein the base web material is a fibrous structure in which a preponderance, by weight, of the fibers are short, cellulosic fibers of a paper making length less than 0.0064 meters (one-quarter inch) such as wood pulp and cotton linters. The base web material can include 100% of such short cellulosic fibers, and when it does, it is preferred that the web material is made in accordance with U.S. Pat. No. 3,879,257—Gentile et al, which is assigned to the assignee of this invention. The base web material can also include a minor proportion, by weight, of textile-length fibers greater than (0.0064 meters (one-quarter inch) in length to reinforce the structure. Preferably the longer textile length fibers are greater than 0.0127 meters (one-half inch) in length and constitute no more than about 30%, by weight, of the fibre composition. Textile-length fibers employed for reinforcing dry-formed webs can include polyester fibers, rayon fibers, or other fibers which are well known in the prior art. It is preferred to make such dry-formed webs having a mixture of short cellulosic fibers and longer textile-length fibers by the method described in U.S. Pat. No. 3,862,472—Norton et al, assigned to the assignee of the present invention. The base web material can have a dry basis weight range of about 0.034 to about 0.085 kilograms per square meter (20 to 50 pounds per ream of 2880 square feet). In one embodiment, the base web material has a preferred dry basis weight of about 0.039 kilograms per square meter (23 pounds per ream of 2880 square feet) and is premoistened so as to have a wet bulk ratio of about 0.012 meters per kilogram per square meter (0.00078 inches per pound per ream of 2880 square feet).

Figure 4:
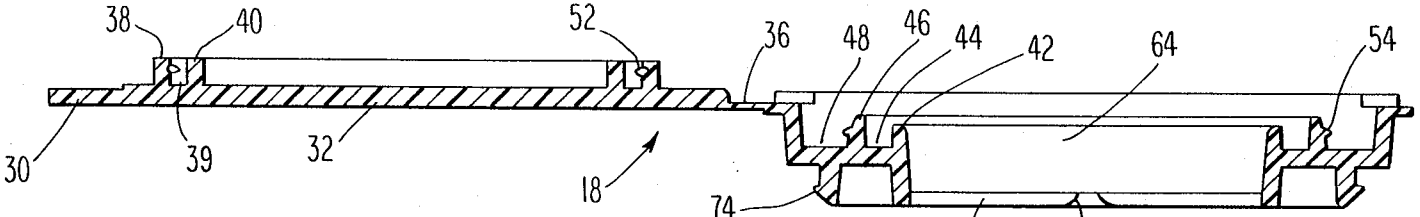
FIG. 4 is a cross-sectional view taken along line 4—4 of FIG. 3.
Figure 3:
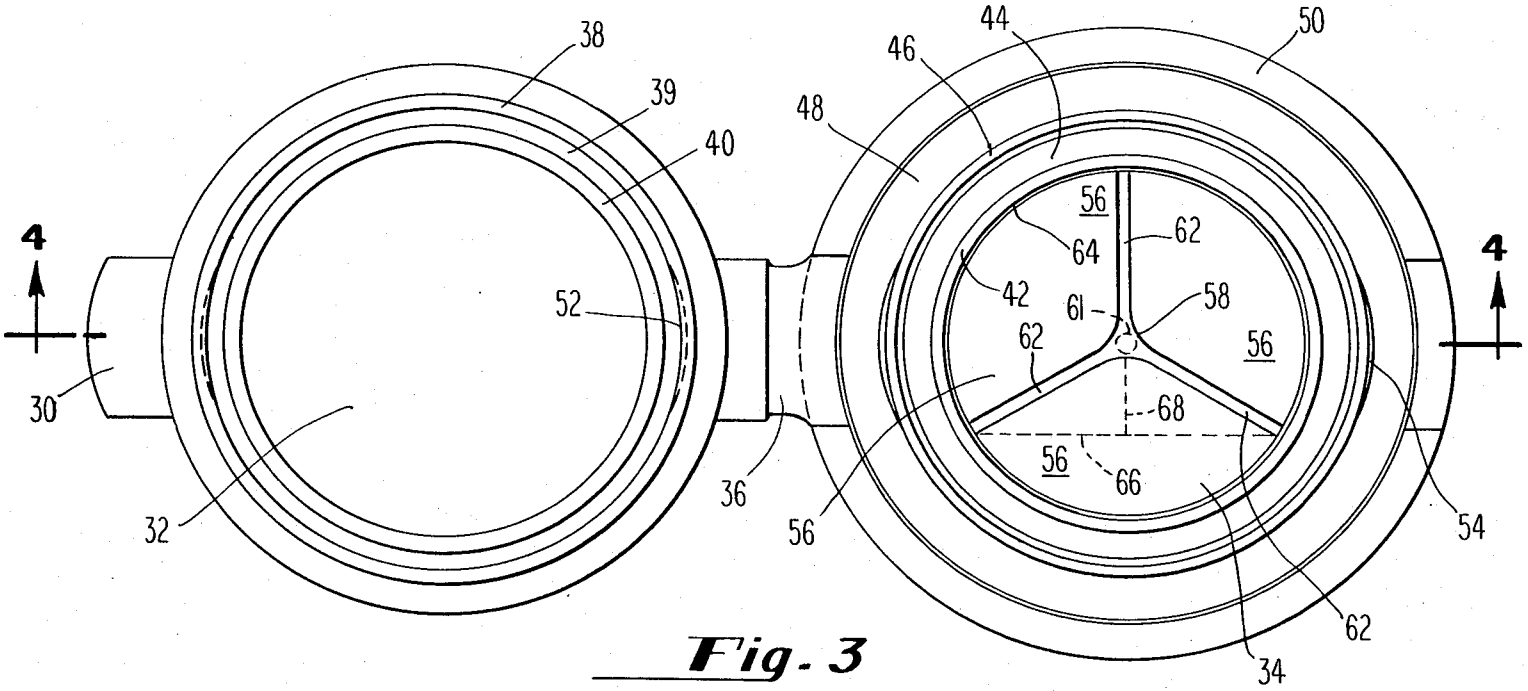
FIG. 3 is a plan view of the preferred embodiment of the dispensing port and cover assembly in an opened condition.

Referring now to FIGS. 3 and 4, there is shown a preferred embodiment of the port subassembly 18. Preferably, the port subassembly 18 is a unitary, molded member consisting of a cap section 32 and a port section 34 connected by a thin hinge 36. The interior of the cap 32 includes an inner annular ridge 40 and an outer annular ridge 38, separated by an annular channel 39. The inner wall of the annular ridge 38 has been provided with two recesses 52 located at opposite sides of the cap 32. The port section 34 includes an inner rim 42 and an annular ridge 46 separated by an internal annular channel 44. The port section 34 also includes an outer rim 50 that is separated from the annular ridge 46 by an outer channel 48. Located on opposite sides of the outer wall of annular ridge 46, are extensions 54. When the cap 32 of the port subassembly 18 is bent about the hinge 36 to cover the dispensing port 34, annular ridge 40 of the cap 42 nests within the channel 44 of the dispensing port section 34; annular ridge 46 of dispensing port section 34 nests within the channel 39 of the cap 32; and annular ridge 38 of the cap 32 nests within the annular outer channel 48 of the dispensing port section 34 in order to provide some additional resistance to evaporation of moisture from the product in the container 10. When the cap 32 is pressed over the dispensing port section 34, the recesses 52 in the inner wall of the ridge 38 engage projections 54 in the outer wall of ridge 46 of the dispensing port section 34 so as to maintain the cap 32 in a covering relationship with the dispensing port section 34. The cap 32 includes a lifting tab 30 which extends beyond the rim 50 of the dispensing port section 34 to provide a convenient member for applying a lifting force on the cap 32 in order to uncover the dispensing port section 34 and to gain access to the tail 75 or tip of the sheet material which extends through the dispensing port section 34 as shown in FIG. 1. Although a preferred capping means has been described, other capping means can be used with the dispensing port of this invention which will now be described.

In one preferred embodiment, the dispensing port through which the premoistened wet tissue is dispensed is formed by three slots 62 that extend radially from an opening, represented by the dashed circle 61, at the center of the dispensing port section 34. The slots 62 are equiangularly spaced to define three sectors 56 within the dispensing port section 34. When a sheet of the product is being dispensed, each sector 56 tends to bend about the dashed line 66. Thus, the equiangularly spaced slots 62 really result in the formation of three obtuse triangular flaps 56 within the dispensing port section 34. The apex 58 of each triangular flap has been rounded, as shown, to remove any sharp points which may cause tearing of the wet web at places other than at the perforations. The lower interior edges 60 of the triangular flaps 56, adjacent to the interior of the container 10, have also been rounded to eliminate sharp edges that can cause the relatively bulkier webs to be torn. Another reason for rounding the lower interior edges 60 of the triangular flaps 56 is to guarantee that when the flaps 56 are pushed upward as when a sheet is being dispensed, the lower edge 60 of the flap 56, which is under tension, does not reduce the slot 62 width which can affect the dispensing characteristic of the flaps 56 and aperture 62. Although it is preferred to round the lower, interior edges 60 of the triangular flaps 56, these lower, interior edges 60 can also be eliminated by chamfering those edges 60.

Figure 5:
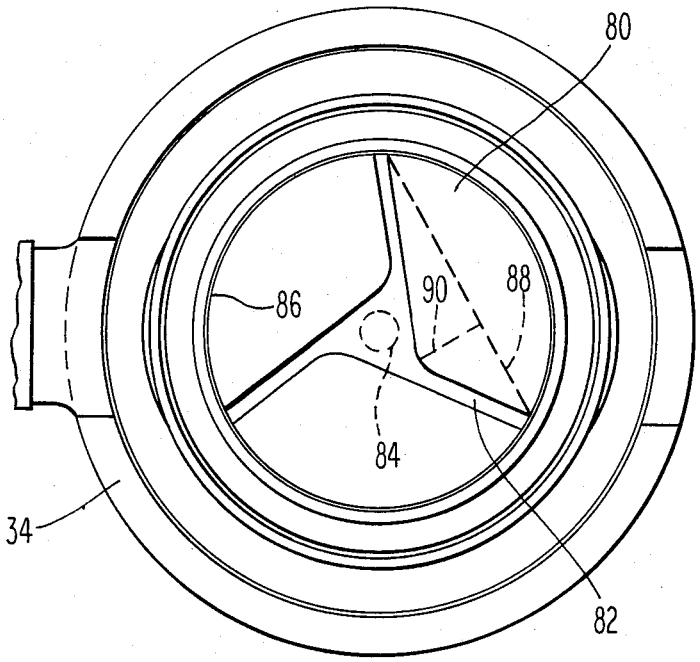
FIG. 5 is a plan view of an alternate embodiment of a dispensing port having three slots and three flaps.

FIG. 5 shows an alternate dispensing port configuration in which three obtuse triangular shaped flaps 80 are formed within the dispensing port section 34. This dispensing port is determined by forming a central aperture or opening such as the circle 84 and forming three slots 82 each being generally tangent to and generally extending away from the central aperture 84. These slots 82 result in the formation within the dispensing port section 34 of three obtuse triangular flaps 80 which tend to bend about the dashed line 88.

In one preferred embodiment of the dispensing port depicted in FIG. 4, the port subassembly 18 was molded using a polyolefin. The diameter of the dispensing port area within the inner wall 64 of inner rim 42 is 0.0254 meters (1 inch). Flaps 56 are 0.0011 meters (0.045 inches) thick. It has been determined that moist, bulky tissues are most efficiently dispensed when the slot width is approximately equal to the wet thickness of the web. Thus, for an air layed web having a dry basis weight of 0.039 kilograms per square meter (23 pounds per ream of 2880 square feet) and an average wet thickness of 0.00046 meters (0.18 inches) the preferred slot width is 0.000483 meters (0.019 inches).

The criteria for selecting the dimensions of a dispensing port illustrated in FIGS. 3 and 4, for a particular product will now be described. The base web material, before it is saturated with a lotion, is an air layed web having a basis weight of 0.039 kilograms per square meter (23 pounds per ream of 2,880 square feet) and an average thickness of 0.00071 meters (0.028 inches). The base web material is than impregnated with about 520 grams of lotion and converted into rolls of 150 sheets, each sheet being 0.15 meters (6 inches) wide and 0.18 meters (7.2 inches) long. The sheets are interconnected by means of a plurality of equally spaced tabs across the 0.15 meter width. To simplify the port evaluation certain parameters of the dispensing port were fixed as follows: port diameter 0.0254 meters (1 inch); the thickness of sector 56, 0.0011 meters (0.045 inches); the radius of the apex 58 of each triangular flap, 0.0032 meters (0.125 inches); and the radius of the lower interior edges 60 of the triangular flaps, 0.0021 meters (0.080 inches). The ability of product having different perforation configurations, to be dispensed through ports having three different slot 62 widths was measured. A first dispensing port A has a slot 62 width of 0.00048–0.00051 meters (0.019–0.020 inches), a second dispensing port B has a slot 62 width of 0.00038–0.00041 meters (0.015–0.016 inches), and a third dispensing port C has a slot 62 width of 0.00043–0.000046 meters (0.017–0.018 inches). The dispensability of premoistened sheets interconnected with tabs of different lengths and different number of tabs was evaluated with ports A, B and C. It was found that the premoistened sheets interconnected with either 12, 13 or 14 tabs, each tab being 1.067 millimeters (0.042 inches), can be dispensed through the three different slot 62 widths A, B and C. The perforation configuration that was finally selected was the 14 tab configuration because the larger number of tabs results in a web that can withstand higher tension during the converting process.

It has also been found that the three slot 62 port with the flexible triangular flaps 56 helps to redistribute and retain lotion within the sheet as it is dispensed. When the roll 14 of lotionized sheets is first placed into the container 10, the sheets tend to be uniformly saturated. Once in the package for a lengthy period of time, the lotion on the roll 14 tends to migrate, due to gravity, towards the bottom of the roll 14 so that the bottom half of a sheet has anywhere from 3 to 4 times more lotion than the top half of a sheet. Once a consumer begins to dispense sheets, so that the tail 75 of the next sheet to be dispensed is located within the dispensing port, that portion of the sheet which is entering the dispensing slots includes heavily saturated sheet portions as well as comparatively dry portions of a sheet. As the web is pulled through the dispensing port, the pressure of the triangular flaps 56 on the sheet causes lotion in the more saturated portions of the sheet to be transferred into the relatively drier portions of the sheet and to be dispensed with the sheet. In evaluating the ability of ports A, B and C to redistribute and retain lotion in the dispensed sheet, rolls 14 saturated with about 520 grams of lotion were dispensed through the ports. It was found that port A allowed about 99.5% of the lotion to be dispensed with the sheets, port C allowed about 97.9% of the lotion to be dispensed with the sheets, and port B allowed about 87.1% of the lotion to be dispensed with the sheets. Based on this data, dispensing port A was selected over dispensing ports B and C.

While the present invention has been described with reference to a specific embodiment thereof, it will be obvious to those skilled in the art that various changes and modifications may be made without departing from the invention in its broader aspects.

What is claimed as new and desired to be secured by Letters Patent of the United States is:

1. An improved dispensing port in a wall of a container for perforated premoistened wipers, the dispensing port consisting of a central opening and three lineal slots tangent to the central opening to form three flexible, obtuse triangular flaps, the obtuse angle of each flap being rounded, the flaps applying tension to a leading wiper being pulled through the slots to cause the leading wiper to be separated from the next wiper at the perforations while leaving a tip of the next wiper projecting through the dispensing port.

2. An improved dispensing port as recited in claim 1 wherein the three slots are equiangularly spaced.

3. An improved dispensing port as recited in claim 1 or 2 wherein the obtuse angle of each flap is rounded.

4. An improved dispensing port as recited in claims 1 or 2 wherein the lower edges of the flaps adjacent the interior of the container are rounded.

5. An improved dispensing port as recited in claims 1 or 2 wherein the width of the slot is approximately equal to the wet thickness of the wiper.

* * * * *